US006061935A

United States Patent [19]

Lee

[11] Patent Number: 6,061,935

[45] Date of Patent: May 16, 2000

[54] APPLIANCE FOR TREATING GARMENT WITH STEAMER AND IRON

[75] Inventor: Chiu Yeung Lee, Hong Kong, The Hong Kong Special Administrative Region of the People's Republic of China

[73] Assignee: Chiaphua Industries Limited, The Hong Kong Special Administrative Region of the People's Republic of China

[21] Appl. No.: 09/173,503

[22] Filed: Oct. 16, 1998

[51] Int. Cl.[7] ..... D06F 75/12; D06F 75/40; D06C 7/00

[52] U.S. Cl. ..... 38/77.6; 68/222

[58] Field of Search ..... 38/75, 77.1, 77.3, 38/77.6, 77.7, 79, 94, 96; 68/222; 392/324, 333, 335, 342, 379; 219/245, 246, 247, 249, 256, 259

[56] References Cited

U.S. PATENT DOCUMENTS

| | | | |
|---|---|---|---|
| 2,247,438 | 7/1941 | Gorton | 38/77.6 |
| 2,661,552 | 12/1953 | Reichold | 38/77.6 |
| 3,272,964 | 9/1966 | Carlos et al. | 38/77.8 |
| 3,581,529 | 6/1971 | Mitchell et al. | 68/222 |
| 3,869,815 | 3/1975 | Bullock | 38/77.6 |
| 4,565,019 | 1/1986 | Cavalli | 38/79 X |
| 4,875,301 | 10/1989 | Adams | 38/75 X |
| 5,428,910 | 7/1995 | Gudefin et al. | 38/77.6 |
| 5,609,047 | 3/1997 | Hellman, Jr. et al. | 68/222 |
| 5,842,295 | 12/1988 | Ching et al. | 38/77.6 |

*Primary Examiner*—Ismael Izaguirre
*Attorney, Agent, or Firm*—Jackson Walker L.L.P.

[57] ABSTRACT

A dual appliance for steam treating garments having a central reservoir and an electrical water pump to supply water to a steamer or a steam iron. Separate braided flexible cables supply water and power to the steamer and to the steam iron, to which the respective cables are respectively permanently connected. Plugs are provided at the ends of the cables for connection to a socket.

2 Claims, 1 Drawing Sheet

APPLIANCE FOR TREATING GARMENT WITH STEAMER AND IRON

BACKGROUND OF THE INVENTION

1. Field of the Invention

The invention relates to an appliance for treating garments.

2. Description of Prior Art

The invention relates more particularly to an appliance for treating garments with steam. Steam is traditionally used when ironing clothes and other garments including curtains and furnishing covers with a so-called "steam iron" that releases steam usually under the manual control of a user. Steamers or "steam wands" are also known to remove creases and crinkles where steam is applied typically to hanging garments and the like. In this way, curtains can for example be treated with steam in situ or after being hung up following cleaning or washing.

In the case of a steam iron, it has already been proposed to supply water to a heated iron from a separate reservoir via a flexible hose. This greatly increases the quantity of water that can be made available for steam ironing. In the case of a steamer, the water is the more usually supplied from a separate reservoir via a suitable hose. It is also known to provide the hose in the form of a cable that is designed to carry water as required and also incorporates electrical wires for supplying power and/or transmitting control signals between the steamer or the iron, as the case may be, and the separate central water reservoir. Typically, the control signals are required to initiate a pump that pumps water, on demand, to the steamer or the steam iron during use.

It has been proposed to have a flexible cable connected to a water reservoir that terminates at a plug or socket so as to provide releasable connection for a steamer or steam iron. In this way either the steamer or the steam iron can be supplied in turn from the same water reservoir. This arrangement has certain disadvantages in that provision of a necessary releasable cable connection at the steamer and at the steam iron makes the steamer and steam iron somewhat physically cumbersome, and the releasable cable connection is at the more vulnerable part of the layout, where maximum flexing and manipulation takes place.

SUMMARY OF THE INVENTION

It is an object of the invention to overcome or at least reduce this problem.

According to the invention there is provided a dual appliance for steaming or steam ironing garments and the like comprising a central water reservoir with an electric pump and a releasable connector to supply water to the steamer or the iron and provide an electrical connection, a steamer having a length of flexible cable attached thereto terminating at a mating adapter for the connector, a steam iron having a length of flexible cable attached thereto terminating at a mating adapter for the connector, in which the steamer and the steam iron have a respective electrical switch for controlling the operation of the pump during use via the flexible cable, and in which electrical power is supplied to the steamer or the steam iron respectively via the flexible cable.

The dual appliance may include central adjustable flow rate controller that is arranged to set a desired flow rate of water between the reservoir and the steamer or steam iron as the case may be.

BRIEF DESCRIPTION OF THE DRAWING

A dual appliance according to the invention will now be described by way of example with reference to the accompanying schematic drawing which shows the appliance.

DESCRIPTION OF THE PREFERRED EMBODIMENTS

Figure 1:
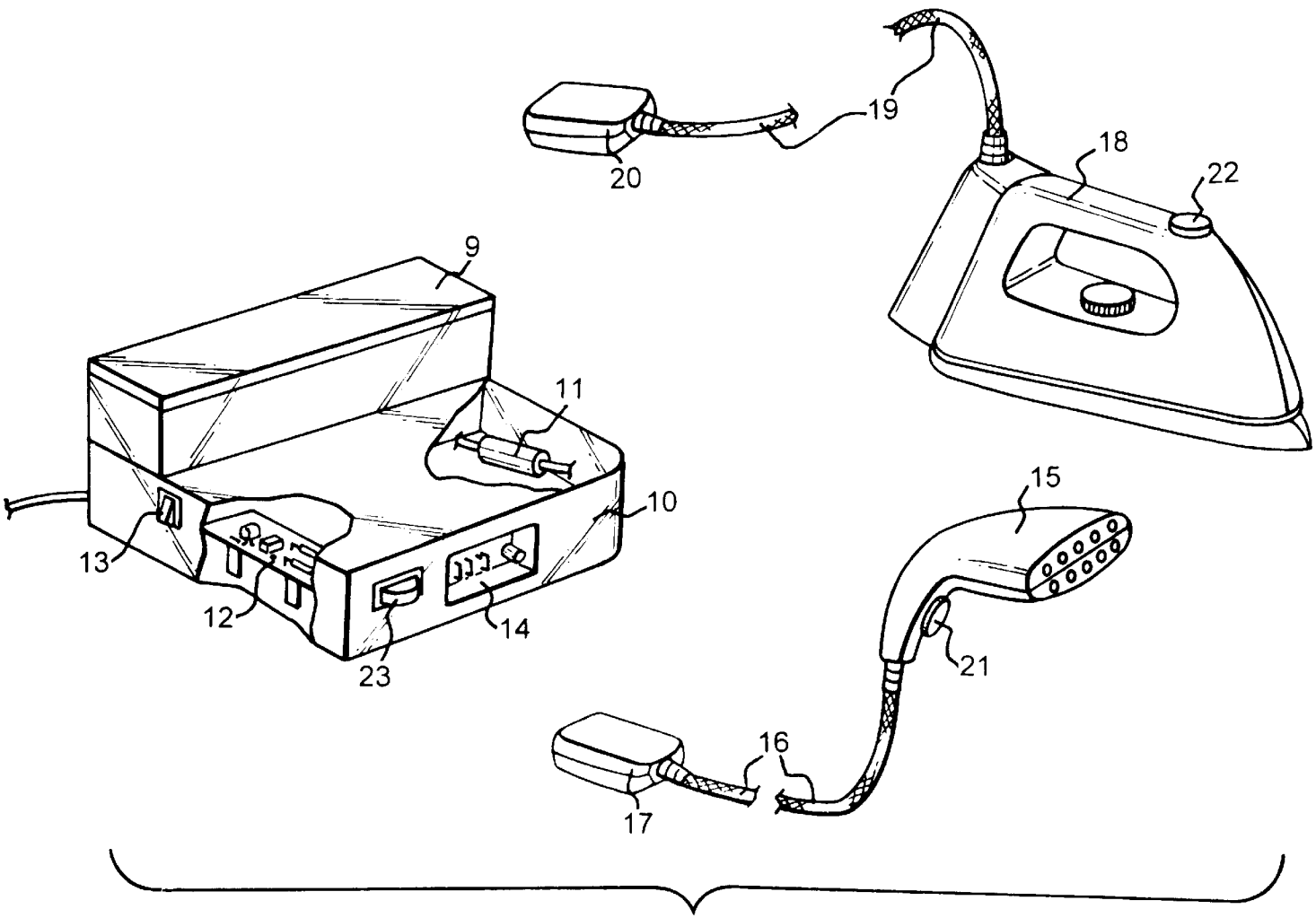

Referring to the drawing, a central water reservoir 9 is mounted on a housing 10 that incorporates an electrically driven pump 11. An electrical control circuit 12 and a manually operable power switch 13 are provided in the housing 10. A cable socket 14 is Mounted in a wall of the housing for supplying water, electrical power and for receiving control signals.

A steamer 15 is permanently connected to one end of a braided flexible cable 16 that includes a tube and appropriate electrical wires to enable water and electrical power to be supplied respectively to the steamer. Suitable flexible cables are generally already known per se. The flexible cable, typically two metres long, terminates at a plug 17 that can be releasably but securely fitted to the socket 14. A steam iron 18 is permanently connected to a braided flexible cable 19, the same as the cable 16, and terminates at a plug 20, the same as plug 17.

Control switches 21 and 22, typically push-button ON/OFF switches, are mounted on the steamer and the steam iron, respectively. In use, operation of the switches 21 or 22 serves to turn on the electrical pump 11 so that water is supplied along the flexible cables 16 or 19. Electrical heaters within the steamer or the steam iron are arranged to heat the water in conventional manner, so that steam can be provided to treat garments "on demand".

A separate pump controller 23 is provided to alter the rate of flow of water when the pump 11 is turned ON because it may be preferable to independently alter the rate at which steam is generated, other than by simply turning the pump ON and OFF at differing intervals to do this using the switches 21 or 22.

The described appliance has respective permanently attached cables at the steamer and at the steam iron which simplifies the required attachments and makes such connecting to the steamer and steam iron inherently less physically bulky. Also, such attaching or connections being permanent are less prone to damage or failure. It is at these particular connections that the greatest strain is likely to occur and if the connections are in the form of, say, plugs and sockets, as presently used in the prior art, there is a greater likelihood of water leakage or other failure. Also, in similar prior art arrangements a flexible cable is permanently attached to the central housing 10 which makes the housing generally difficult to pack away for storage, for example. In terms of serviceability, by having in practice two flexible cables, 16 and 19, the described dual appliance has an inherently longer life. It will be appreciated that this is because the flexible cables are traditionally the more vulnerable components of these kinds of steam appliances; each flexible cable in the described appliance being in use in effect for only part of the time instead of all the time the appliances are in service.

The connector 14 in the described arrangement is a socket but may be a plug or take any suitable form of releasable connector. The plugs 17 and 20 are always provided as like "adapters" to make connections with the common or central connector 14.

I claim:

1. A dual appliance for steam treating garments comprising:

a central water reservoir with an electric pump connected to a supply water and electrical connector;

a steamer having a first length of flexible cable terminating at a first mating adapter for releasable connection to said supply water and electrical connector;

a steam iron having a second length of flexible cable terminating at a second mating adapter for releasable connection to said supply water and electrical connector, said steamer and said steam iron each having a respective electrical switch for controlling the operation of said pump during use via said first and second flexible cables, electrical power being supplied to said steamer or said steam iron respectively via said flexible cables.

2. A dual appliance according to claim 1, further comprising a central adjustable flow rate controller to set a desired flow rate of water between said reservoir and said steamer or steam iron.

* * * * *